United States Patent [19]

Zimmermann

[11] Patent Number: 4,607,610

[45] Date of Patent: Aug. 26, 1986

[54] DOWNDRAFT STOVE WITH TUBULAR GRATING

[76] Inventor: Hans G. Zimmermann, 1844 Southmount, St. Bruno de Montarville, Quebec, Canada, J3V 4N3

[21] Appl. No.: 781,463

[22] Filed: Sep. 30, 1985

[51] Int. Cl.[4] ..... F24B 5/04

[52] U.S. Cl. ..... 126/76; 126/74; 126/77; 126/163 R

[58] Field of Search ..... 126/73, 74, 76, 77, 126/163 R; 110/298, 302

[56] References Cited

U.S. PATENT DOCUMENTS

| | | | |
|---|---|---|---|
| 86,072 | 1/1869 | Hosford | 126/76 |
| 638,289 | 12/1899 | Smith | 126/73 |
| 2,070,894 | 2/1937 | Gorsuch | 126/163 R |
| 2,452,843 | 11/1948 | Esnault-Pelterie | 126/73 X |
| 4,182,304 | 1/1980 | Mele | 126/76 |

FOREIGN PATENT DOCUMENTS

| | | | |
|---|---|---|---|
| 170695 | 8/1951 | Austria | 126/73 |

*Primary Examiner*—Samuel Scott
*Assistant Examiner*—Allen J. Flanigan
*Attorney, Agent, or Firm*—R. Craig Armstrong

[57] ABSTRACT

A downdraft stove with a conical reaction chamber surrounded by a heat-insulating mass is disclosed. A tubular grating installed in the reaction chamber has a substantially vertically oriented central tube open at its upper end and connected at its lower end to an air inlet opening, and a cap supported above the open upper end, the spaced between the cap and the upper end constituting a primary air inlet nozzle. A plurality of grating tubes are radially distributed around and take off substantially horizontally from and communicate with the central tube, thereby defining a grating, and then turn downwardly into a conical shape conforming to the reaction chamber shape and are open at their downward ends to thereby constitute secondary air inlets. The downward-projecting ends of the grating tubes are twisted about the axis of the central tube in order to induce a swirling air flow pattern in the reaction chamber. A gate ring valve is supported within the central tube and is automatically raised or lowered to reveal or cover the openings from the central tube to the grating tubes to thereby adjust the ratio of primary inlet air to secondary inlet air, via temperature responsive means such as bimetals connected for sensing temperature differential between primary and secondary combustion sites. A liquid addition nozzle exits under an extra cap provided in the area of the primary air inlet nozzle.

11 Claims, 4 Drawing Figures

DOWNDRAFT STOVE WITH TUBULAR GRATING

BACKGROUND OF THE INVENTION

Field of the Invention

This invention relates to downdraft stoves, and to a novel tubular grating for such stoves.

Downdrafters have been used in woodburning stoves and other combustion units for some time. A downdrafter provides uniform combustion during and after refuelling intervals, which is impossible to achieve in an updrafter with vertical filling and combustion.

The primary disadvantage of an updrafter is that combustible material is roasted prior to being ignited. First the volatives ignite, and if there are many, insufficient oxygen will be present for complete combustion. Then while the fire builds up, intensive heat chars the fuel adjacent to the embers and hot combustion products dehydrate the overyling fuel, resulting in a mixture of pyrolytic and primary combustion products, which rarely are completely burned, and continuously vary in composition. Finally, as combustion progresses to a steady state heat output, mostly charcoal is burnt, but again mosly incompletely as the amount of air admitted must be restricted to limit the rate of combustion.

In a downdrafter all the subsequent stages of combustion are simultaneous and the release of volatiles and primary combustion products are much more uniform across the burn up cycle. Fuel is ignited by radiation rather than convection of ascending fuel gas. Moisture emanates at an even rate and not all at once, thus preventing the chill and subsequent change in burnup rate and combustion gas composition associated with updrafters, when freshly stoked.

The disadvantage of the downdrafter is the inverted draft direction. The surrounding atmoshpere pushes warmer and therefore less dense gases upwards rather than downwards unless there is no upward escape and a pressure differential can be established between the air/flue gas interface and the site of the combustion in progress. In practical terms this means that a minimum amount of draft tightness has to be provided to make a downdrafter functional.

However, no downdrafter guarantees complete combustion per se. It merely provides better control of combustion by the nature of its geometry. Additional features that tend to ensure completeness of combustion are the subject of this invention.

Controlled combustion can be achieved by limiting the amount of primary air allowed into the primary combustion zone while at the same time offering ample surface contact above ignition temperature to ensure complete consumption of the oxygen.

Complete combustion can be achieved by offering surplus oxygen at a point where it will not further entertain primary combustion but still contain sufficient heat to react with primary combustion products (incompletely burned components, volatiles and pyrolites and mainly carbon monoxide).

Controlled combustion is a precondition for complete combustion. Complete combustion can only be achieved if sufficiently high temperatures and sufficient surplus oxygen are provided before the components are allowed to escape.

These two conditions of complete combustion are somewhat difficult to reconcile and are in fact the main stumbling blocks of even modern types of advanced combustion technology. The catalytic converters commonly offered today as the ne plus ultra in woodburning stoves can be considered as tokens of admitted defeat in this endeavour.

It is desired to provide a stove capable of burning combustibles of solid consistency of very varied origin, simultaneously if necessary, with substantially complete combustion for optimal net heat output and environmental suitability. The unit should be useable for combined combustion of solid and liquid and even gaseous fuels, when used in conjunction with accessories. The unit should be useable where the primary concern is heat generation, or where it is waste elimination, or where both are desired and the combustible matter is capable of generating adequate heat. The stove ideally should be capable of continuous operation with intermittent recharging and ash removal, without interruption of combustion, although solid incombustibles larger than the grating may have to be removed after burn out and cooling.

SUMMARY OF THE INVENTION

It is an object of the invention to provide an improved downdraft stove in order to achieve controlled and substantially complete combustion. Thus in accordance with one aspect of the present invention there is provided a tubular grating assembly for positioning in a reaction chamber. The tubular grating comprises a substantially vertically oriented central tube open at its upper end and connected at its lower end to an air inlet opening, a cap supported above the open upper end, the space between the cap and the upper end constituting a primary air inlet nozzle. A plurality of grating tubes are radially distributed around and take off substantially horizontally from and communicate with the central tube, thereby defining a grating, and thence turn downwardly and are open at their downward ends to thereby constitute secondary air inlets. Further features of the tubular grating are described in greater detail below.

In accordance with another aspect of the invention, there is provided a downdraft stove, comprising a conical reaction chamber, the cone of the reaction chamber opening upwardly, and the tubular grating in an essentially conical form, installed in the reaction chamber.

In accordance with another aspect of the invention, a gate ring valve is supported within the central tube and is raisable and lowerable to reveal or cover the openings from the central tube to the grating tubes to thereby adjust the ratio of primary inlet air to secondary inlet air. Temperature responsive means, such as bimetals, are connected for sensing temperature differential between primary and secondary combustion sites and for raising and lowering the gate ring accordingly to reveal or cover the openings to the grating tubes to thereby adjust the air ratio.

In accordance with another aspect of the invention, a liquid addition nozzle which exits under an extra cap provided in the area of the primary air inlet nozzle is provided, and a liquid feeder tube is connected thereto for supplying liquid from an external liquid source.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

General Structure

Figure 1:
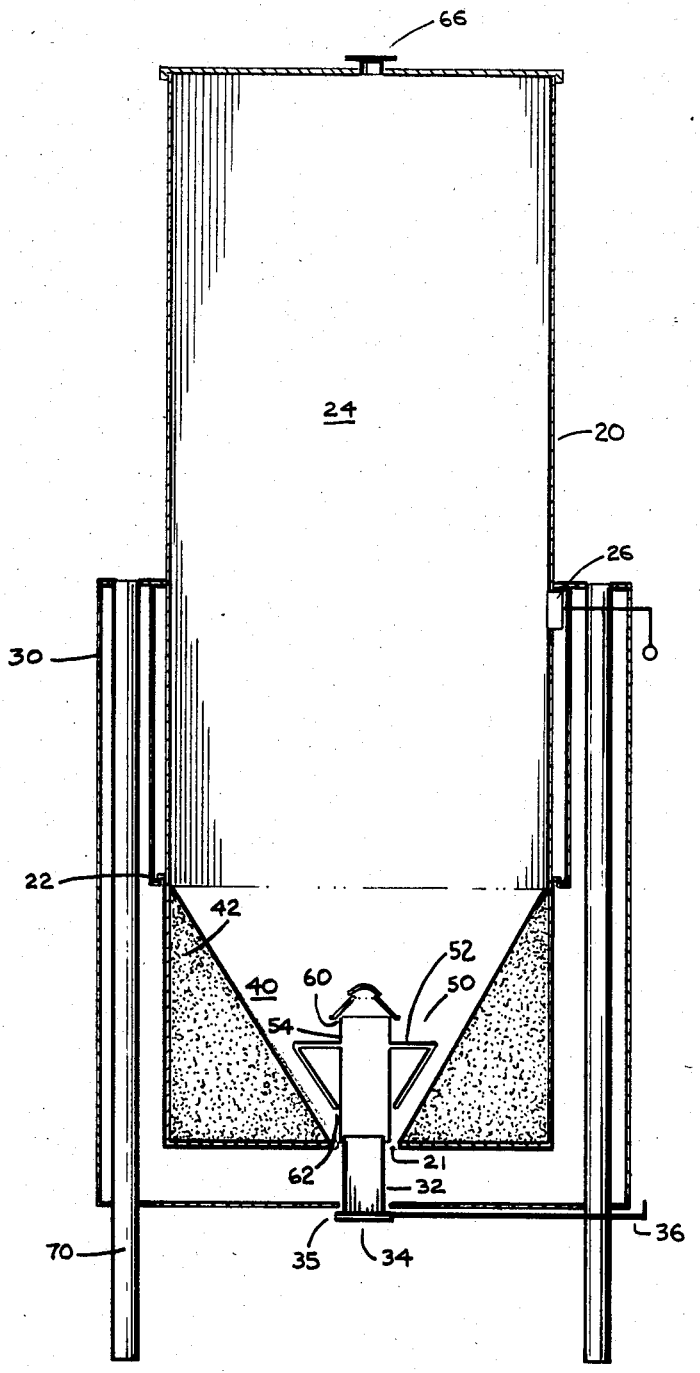
FIG. 1 is a cross-sectional elevation view of the preferred embodiment.

Referring first to FIG. 1, two concentric containers, namely the inner container 20 and the outer container 30, form the main structural parts of the unit. They are sealed draft tight between each other and to the outside except for certain passages to be described later.

The inner container is supported by the outer container, suspended in a lip seal 22 which preferably has a sealing filler of ashes and sand. This allows for stressfree thermal expansion between the two containers. The lower part of the inner container constitutes the combustion or reaction chamber 40 which is conically shaped and embedded in a heat insulating mass 42. In the centre of the reaction chamber is a tubular grating assembly 50 having a primary air inlet nozzle 60 on the upper end and secondary air inlet nozzles 62. The tubular grating assembly is slipped over the central shaft 32 which protrudes upwardly from the bottom of the outer container through the exit opening 21 of the inner container 20.

Heat exchange tubes 70 penetrate the space between inner container 20 and outer container 30. These heat exchanger tubes are representative of any desired kind of heat exchange, air convection, forced draft, liquid thermosyphon or forced circulation.

The air intake 34 is at the bottom of the central tube 32. At the air intake an integral manually or thermostatically controlled gate valve 35 controls the air intake. A shaker mechanism 36 that lifts the tubular grating assembly partially out of its seat may be manually or automatically operated.

The space above the tubular grating assembly is the fuel holding bin 24. The size of it depends entirely on the desired stoking frequency.

The dimensions of a typical medium sized unit with a heat generating capacity of approximately 10,000 watts are as follows:

Width: 80 centimeters
Inner container: 60 centimeters
Height: 180 centimeters
Outer container: 100 centimeters The heat insulating mass 42 of the reaction chamber serves to restrict heat losses laterally which otherwise would jeopardize a prime objective of the conical geometry, namely the focussing of all available heat on the point of secondary conbustion. Ideally no heat loss should occur before the combustion products have left the narrow exit opening 21 of the reaction chamber 40. Practically, this is impossible, but not unlimitable. Radiation losses are incurred upwards of the reaction chamber. Some upward heat radiation is necessary in order to decompose and ignite fuel, but this should be minimized if optimum performance is the objective. A densely packed fuel holding bin 24 will limit the penetration of radiation to the area close to the reaction chamber 40. This means that if big chunks of fuel are beside each other in the fuel holding bin 24, it is desirable to fill the interstices with smaller size fuels. Even complete blockage of air passage in the fuel holding bin 24 is fine because such blockage has no negative repercussions on the ease of combustion, which is entirely dependent on the air from the primary air inlet nozzle 60.

A vent 26 leading into the fuel holding bin 24 is provided, partly as a safety device. It is used whenever the lid is to be opened for refuelling and at the kindling stage to assist in establishing a sizeable bed of embers that can promote radiation ignition of overlying fuel.

The Tubular Grating

Figure 2:
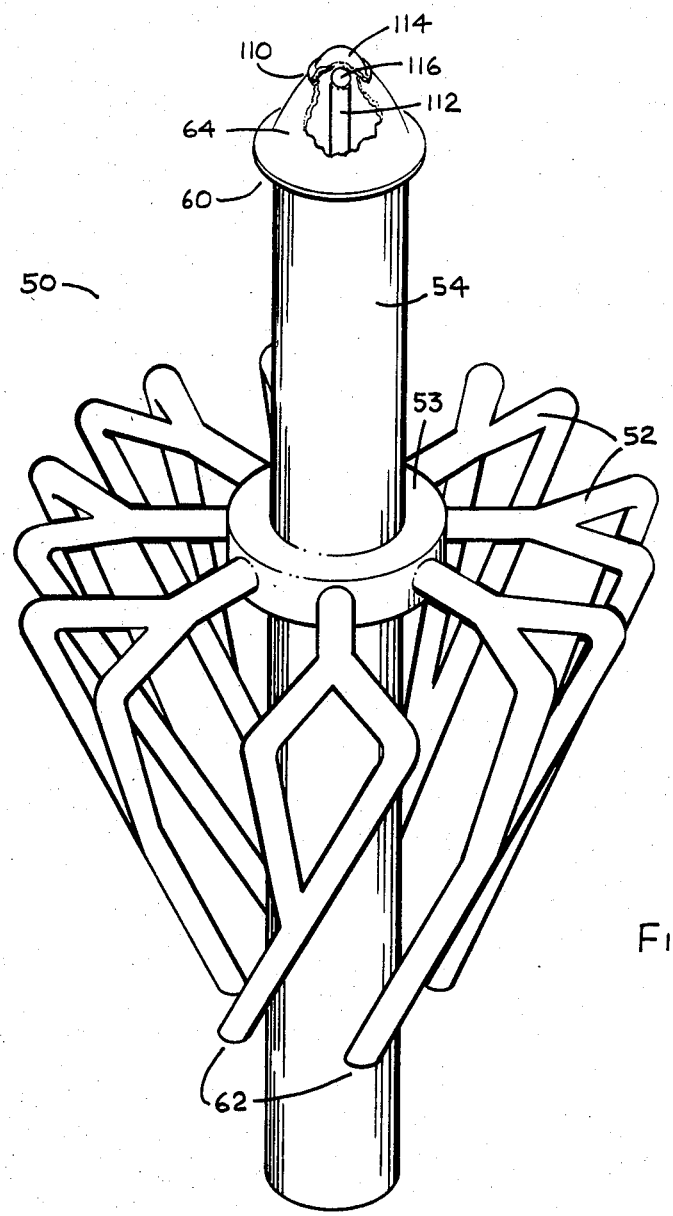
FIG. 2 is a perspective view of the tubular grating in the preferred embodiment.

The tubular grating assembly 50 will now be described in greater detail, with reference to FIG. 2.

The primary air inlet nozzle 60 is the capped end of the central tube 54 protruding upwardly from the centre of the grating. From it primary combustion air diffuses downwardly into the bed of embers which rest on the grating tubes 52. The grating tubes support most of the charge of fuel. Being in the centre of primary combustion, the grating tubes are in intimate contact with glowimg embers. The grating tubes, being hollow, serve as heat exchangers for the secondary combustion air which is conveyed through a plenum 53, to the grating tubes 52, and thence to the tube outlets, which serve as secondary air inlet nozzles 62.

In its basic form the tubular grating assembly 50 has a fixed primary to secondary air ratio given by the dynamic air flow resistance of the primay air inlet nozzle 60 as compared to that of the grating tubes 52 branching off from the central tube 54 via the plenum 53. This fixed ratio allows for a sufficient surplus of oxygen for most fuels of known composition. For optimal heat exchange, the grating tubes 52 should expose large surface area to the embers. On the other hand, the spacing between grating tubes must be sufficient to allow for the free flow of gas and ashes. Thus in the preferred embodiment eight branches take off from the central tube 54 via the plenum 53 and branch once more near the periphery of the grating as the spaces between grating tubes 52 becomes wider, then bend downwards and inwards towards the central tube 54 to conform to the conical shape of the reaction chamber 40, then reunite into eight tubes again. The grating tubes 52 are twisted slightly about the axis of the central tube 54, so that the secondary air is induced into a spin. This spiral air movement provides better mixing of secondary air with primary combustion products and homogenizes any temperature differences within the reaction chamber. The cyclonic air movement also helps to settle ash particles.

An optional feature is a catalytic converter. If desired, strands of platinum metal group wires may be attached to the grating tubes 52 near their outlets for catalytic boosting of secondary combustion at lower temperatures (i.e. during the start-up period or when using fuels with low net heat output), in such a way as not to obstruct ashes from falling. This optional feature is not illustrated. This is not necessary if the unit is at its operational temperature at the secondary combustion site, but before thermal equilibrium is reached a catalytic converter can help to ensure complete combustion at a much lower temperature.

Catalytic converters cannot be used in one of the main applications of the stove, namely mixed garbage combustion. The contents would very soon poison the catalyst and thus render it inefficient.

In an alternate form, a more specialized tubular grating assembly 50 contains a mechanism which allows air ratio variation. This of course can be accomplished in a number of ways. For example, a gate valve in the form of a cylinder which can be hand set to choke the openings of the grating tubes 52 from the plenum 53 could be installed. Alternatively, this may be achieved automatically, by means of the novel device described below, which the inventor calls a "differential thermoregulator".

The Differential Thermoregulator

Automatic means for controlling air ratio variation are desireable because some fuels exude more volatiles than others when burned with the same amount of oxygen. Resinous wood and plastics, for example, both demand more secondary combustion air than, for example, beechwood. The primary products arrive at the secondary combustion site much more "rich" than otherwise. More of the secondary oxygen is consumed and hence more heat is produced, resulting in a larger than normal temperature differential between primary and secondary combustion sites.

The differential thermoregulator 80 constantly compares the temperatures between the primary and secondary combustion sites and if the lower site gets hotter than normal will admit more air into the secondary branch. The whole principle of course rests on the assumption that too much secondary air adversely affects completeness of combustion.

It can easily be understood that too much secondary air has a doubly negative effect on complete combustion:

Firstly, the cooling effect of more secondary air results in lower primary combustion and a lower temperature of the secondary air as compared to smaller throughput of secondary air.

Secondly, if in addition to lower temperature more air than required is mixed in with the primary combustion products, the ignition temperature of the mixture is raised.

On the other hand, it is evident that insufficient air will not allow for complete secondary combustion.

It follows that there is an optimum for complete combustion which is governed by the fuel composition and an appropriate ratio of primary to secondary air. Varying fuel composition must be reflected in the primary/-secondary air ratio. The differential thermoregulator provides the mechanism which automatically adjusts that ratio for optimum combustion efficiency.

Figure 3:
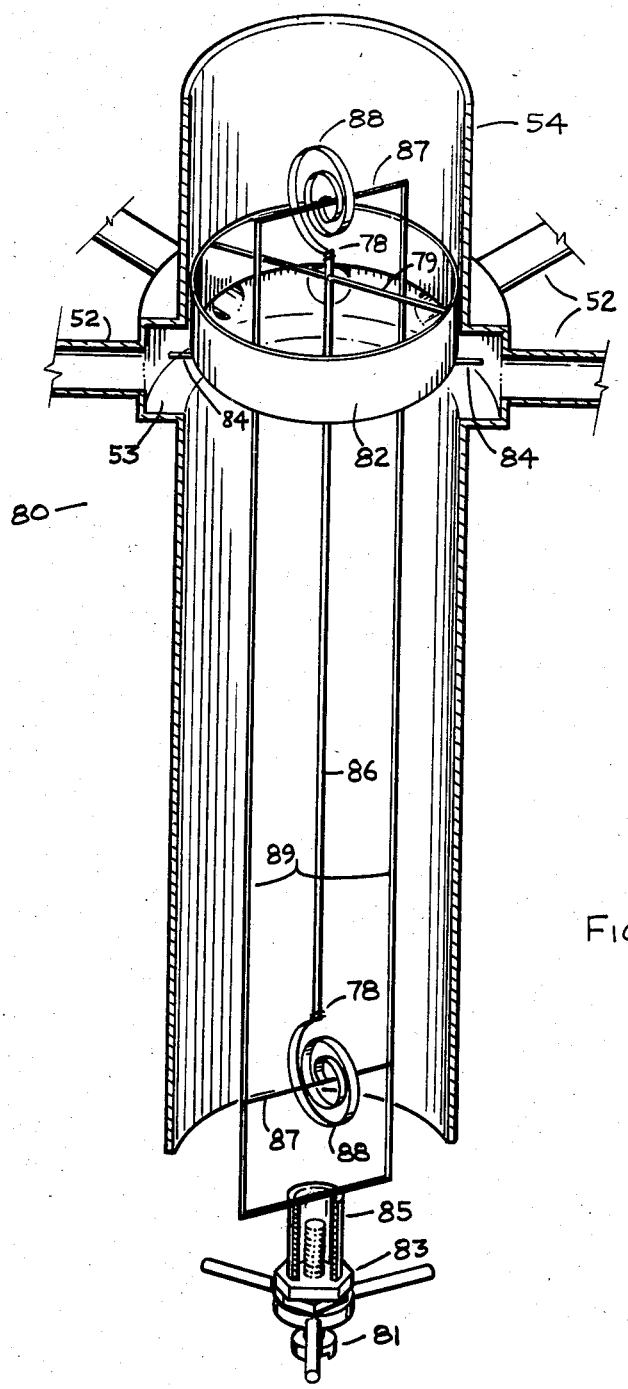
FIG. 3 is a perspective drawing of a differential thermoregulator in the preferred embodiment.
Figure 4:
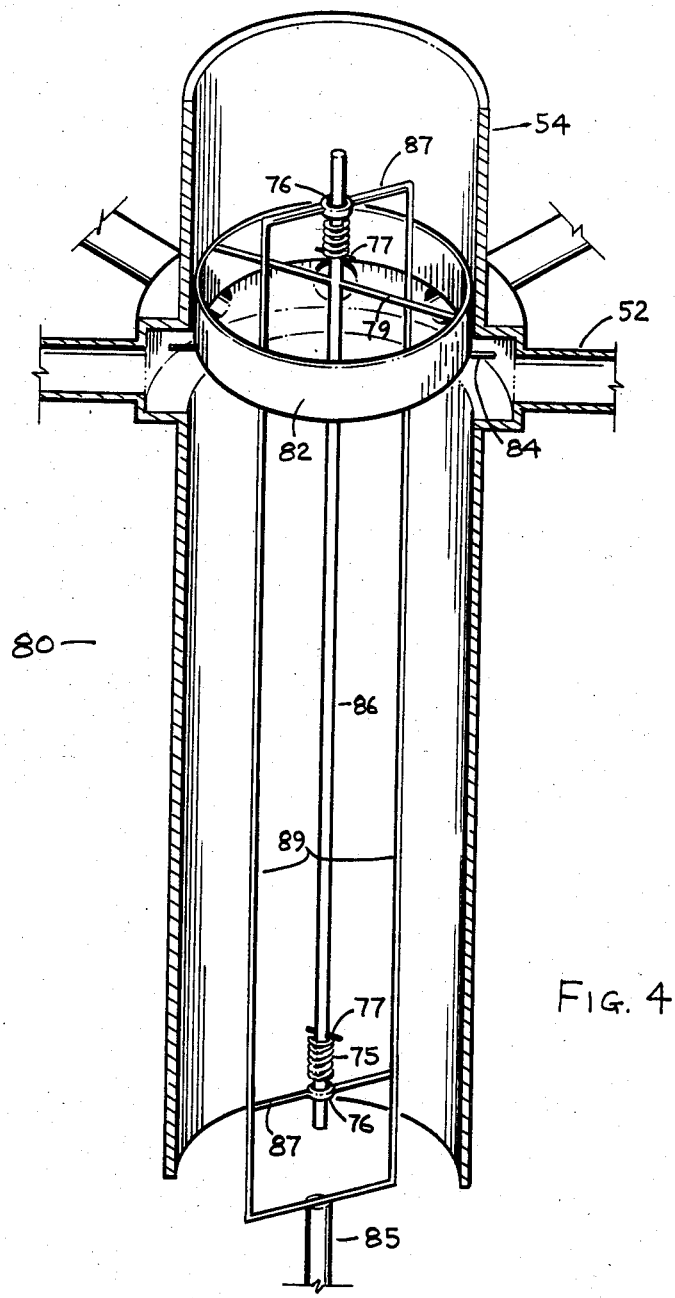
FIG. 4 is a perspective drawing of an alternative embodiment of the differential thermoregulator.

Referring to FIG. 3, the differential thermoregulator 80 consists of a cylindrical gate ring 82 which regulates the amount of air into the secondary branch in response to volative content, at the plenum 53 leading from the central tube 54. The "normal" setting is such that the gate ring 82 rests on set stops 84 which leave a substantial part of the tube opening covered. The primary to secondary air ratio would thus be optimal for a chosen fuel standard.

The gate ring is loosely fitted into the central tube 54 and attached to a central rod 86 via a bridge 79, the central rod being connected by a hinge link 78 to the free outer ends of bimetal spirals 88 on both upper and lower ends. The bimetal spirals 88 are mounted such as to oppose each other's action on simultaneous temperature increase or decrease of both of them. Thus a general change in heat output of the unit does not change the relative position of the gate valve.

The fixed centre ends of the bimetal spirals are connected by a symmetrical pair of vertical bars 89 via two small bridge bars 87, thus providing a rigid structure which ensures that the centres remain at a constant distance. As the bridge bars 87 are of the same material as the vertical bars 89, no stress develops between them by thermal expansion. The structure is put together under no-stress conditions (isothermally).

Temperature differences between the two spirals will result in a relative change of position between rod 86 and vertical bars 89. The lower end of the differential thermoregulator is guided by an attached tube 85 which rests on a set screw 83 which is threaded on a center bolt 81. The differential thermoregulator gate blocks part of the grating tube openings in a position which has been experimentally determined to be optimal for the reference standard fuel combustion. This is done by the position of the set stops 84. Then at steady state operational conditions the set screw 83 is adjusted so that it just begins to lift the gate valve ring 82 away from the set stops 84. In this way only an increase at the secondary (lower) bimetal spiral 88 will open the gate valve further, whereas an increase at the primary site will leave the gate seated but lift the structure from the supporting set screw 83. The regulating mechanism will engage only once this spacing has been regressed to normal. The intention behind this feature is to keep the ratio constant without change in the air admission rate during warm up and when sudden changes in fuel disposition at the primary combustion site occur. The inverse case, namely a sudden reduction in the upper temperature at constant lower temperature, is by nature impossible. The differential thermoregulator will engage only when at the lower secondary site a persistent temperature increase happens, and will revert to normal after it has disappeared. This must not be confused with the general heat output of the unit, which is controlled by the gate valve 35 on the air intake 34 at the bottom of the outer container 30. If a change in total heat output is encountered by the increased combustion triggered by more volatile content in the primary combustion products (and the subsequent engaging of the differential thermoregulator), the total air admitted if thermostatically controlled will be reduced, thus diminishing primary and secondary combustion but not the ratio adjustment, which is effective as long as volatile content is higher than normal. A hand set air flow control will not be as efficient even though it too remains a limiting parameter on heat output.

An alternate version of the differential thermoregulator is a helical version, which functions in the same way as the spiral version, but is possibly simpler to assemble.

The hinge link 78 of the spiral version is replaced by a stop 77. The bridge bars 87 each contain a hole 76 that allows free float of the central rod 86.

The helical bimetal screw 75 expands and contracts between its two stops and thus provides for the floating movement of the central rod 86 and the gate ring 82 to which it is fixed via the bridge 79.

The set stops 84 for the gate ring 82 are fixed such that normally half the access to the plenum 53 and thus to the grating tubes 52 is covered. Therefore, at least twice as much air is admitted when the gate ring 82 is lifted as far as to fully open the grating tubes 52. As a result, the amount going to the primary air inlet nozzle 60 is proportionally less and therefore the amount of primary combustion products diminishes. It must be borne in mind that the inertia of the total mass of red hot embers will not immediately cool off and thus release fewer volatiles; the primary effect will be only less primary combustion (less CO and other incompletely burned components), whereas pyrolytes will only gradually decrease as the temperature of the primary bed decreases. However, the additional amount of air that is now supplied to the secondary combustion site will be able to burn the excessive proportion of volatiles deviating from the normal fuel composition. Now as the excessive amount of volatiles becomes depleted, the lower bimetal gets less heat and contracts, allowing the gate ring 82 to return to a lower position and finally settle on the set stops 84. These set stops 84 (three of them equidistantly arranged on the circumference of the central tube 54) are to be installed only after the whole mechanism has been inserted in the central tube with screws fitting into threaded holes in the central tube wall between the tubular grating's take off from the central tube.

It is evident to the experienced that the differential thermoregulator principle can be applied with any temperature sensing device that lends itself to differentiation; if one installs instead of bimetallic coils, two thermocouples at the positions where temperature comparison is most sensitive to differences between primary and secondary combustion, one can wire the two legs electrically in such a way that the thermovoltages at equal temperature (or at a chosen present differential) compensate each other and that only when the secondary combustion temperature reaches a threshold differential value as compared to the primary combustion temperature, a device is triggered (say a solenoid which gets as much magnetic field strength as the differential thermovoltage suggests) that lifts the gate valve proportionally to the signal created.

The same analogy applies for resistance thermometers.

Liquid Addition Nozzle

Liquids (and gases as well) can be added when burning solids with the stove, if desired. These additions may be for quite different reasons such as combustion of liquid combustible waste, combustion of combustible waste containing aqueous solutions and emulsions, and boosting combustibility of poorly combustible solid and liquid wastes. The liquid must be fed in a controlled way so as to meet fuel/oxidant requirements; aqueous solutions and emulsions may only be fed at a rate which respects minimum temperature requirements at the secondary combustion site.

The liquid addition nozzle 110 is fed by a feeder tube 112 which exits under the extra cap 114 at the tip of the primary air inlet nozzle 60. There is a flash back prevention ball checkvalve 116 seated between the feeder tube 112 and the extra cap 114. The feeder tube is connected outside the central tube 54 under the bottom of the outer container 30 by a swagelok fitting to the liquid supply line (not illustrated). The feeder tube 112 may or may not be thermally insulated, depending on the liquid fed. It does not necessarily have to be mounted in the centre of the central tube 54 if there is also a differential thermoregulator installed, since the differential thermoregulator must be installed in the centre of the central tube.

The liquid oozes out the nozzle sideways and runs down the primary air inlet nozzle cap 64 where it may be vaporized and ignited or not. If it does not ignite there it will ignite at the secondary combustion site along with other unburnt volatiles.

Liquids that have a tendency to incrust under thermal duress cannot be fed through this liquid addition nozzle, but from above to free fall out of a zone of low temperature. The simultaneous combustion of organic liquids and solid fuels has certain advantages of the kinetics of the combustion process in that the liquids are being bounced around among highly reactive surfaces (glowing embers) which promote break down of certain tough-to-decompose substances. Furthermore, the ashes resulting from the ash combustion provide an excellent reaction partner for organochlorine combustion products: They intercept those radicals which in the absence of more reactive reaction partners have a tendency to form toxic components (like the dioxins). It is for this reason that such an application seems to be highly interesting in the context of toxic waste elimination.

Operation

The ashes are conveyed across the tubular grating assembly 50 down into the ash pit where they are allowed to settle. Clogging of the narrows at the secondary combustion site is very unlikely because of the high linear air/gas speeds at this point. An occasional chunk of fuel caught in the passage will be rapidly consumed. Non-combustible larger-than-grating-interstices-size pieces must be removed periodically from the reaction chamber. A manual or automatic shaker is helpful in the event that doming ever occurs.

The unit is also provided with an auxiliary air inlet nozzle 66 in the lid, which serves to maintain a small current of air to continuously sweep the fuel storage bin to prevent stagnant explosive gas mixture build up. This is particularly indicated when fuels are not densely packed. The auxiliary air inlet nozzle 66 also supplies part of the primary combustion air. Its temporary absence when blockage by dense packing occurs is not detrimental to entertaining primary combustion, as this is entirely controlled by the thermostatically set air intake 34 which opens or closes according to the entire (net) heat output of the furnace, nor is it dangerous from the explosive-gas-mixture point of view because of the negative pressure differential between the auxiliary air inlet and the reaction chamber 40.

It will be appreciated that the above description relates to the preferred embodiment and variations thereon by way of example only. Many variations on the invention will be obvious to those knowledgeable in the field, and such obvious variations are within the scope of the invention as described and claimed, whether or not expressly described.

What is claimed as the invention is:

1. In a downdraft stove, a tubular grating assembly for positioning in a reaction chamber, comprising:

a substantially vertically oriented central tube open at its upper end and connected at its lower end to an air inlet opening;

a cap supported above said open upper end for protecting said open upper end from entry of matter, the space between said cap and said upper end constituting a primary air inlet nozzle;

a plurality of grating tubes radially distributed around and taking off substantially horizontally from and communicating with said central tube, thereby defining a grating, and thence turning downwardly and being open at their downward ends to thereby constitute secondary air inlets.

2. A tubular grating assembly as recited in claim 1, in which said grating tubes converge into a conical shape after turning downwardly.

3. A tubular grating assembly as recited in claim 2, in which the downward-projecting ends of said grating tubes are twisted about the axis of the central tube and the secondary air inlets are thus deflected in the lateral direction in order to induce a swirling air flow pattern.

4. A downdraft stove, comprising a conical reaction chamber, the cone of said reaction chamber opening upwardly, and an essentially conical tubular grating installed in said reaction chamber, said tubular grating assembly comprising a substantially vertically oriented central tube open at its upper end and connected at its lower end to an air inlet opening; a cap supported above said open upper end for protecting said open upper end from entry of matter, the space between said cap and said upper end constituting a primary air inlet nozzle; a plurality of grating tubes radially distributed around and taking off substantially horizontally from and communicating with said central tube, thereby defining a grating, and thence turning downwardly and being open at their downward ends to thereby constitute secondary air inlets, in which said grating tubes converge into a conical shape after turning downwardly.

5. A downdraft stove as recited in claim 4, in which the downward-projecting ends of said grating tubes are twisted about the axis of the central tube and the secondary air inlets are thus deflected in the lateral direction in order to induce a swirling air flow pattern.

6. A downdraft stove as recited in claim 3, further comprising a gate ring valve supported within said central tube and being raisable and lowerable to reveal or cover the openings from said central tube to said grating tubes to thereby adjust the ratio of primary inlet air to secondary inlet air, and temperature responsive means connected for sensing temperature differential between primary and secondary combustion sites and for raising and lowering said gate ring accordingly to reveal or cover said openings to said grating tubes to thereby adjust the air ratio.

7. A downdraft stove as recited in claim 4, in which said temperature responsive means comprises two bimetal elements.

8. A downdraft stove as recited in claim 4, further comprising a liquid addition nozzle which exits under an extra cap provided in the area of said primary air inlet nozzle, and a liquid feeder tube connected thereto for supplying liquid from an external liquid source.

9. A downdraft stove as recited in claim 5, further comprising a liquid addition nozzle which exits under an extra cap provided in the area of said primary air inlet nozzle, and a liquid feeder tube connected thereto for supplying liquid from an external liquid source.

10. A downdraft stove as recited in claim 6, further comprising a liquid addition nozzle which exits under an extra cap provided in the area of said primary air inlet nozzle, and a liquid feeder tube connected thereto for supplying liquid from an external liquid source.

11. A downdraft stove as recited in claim 7, further comprising a liquid addition nozzle which exits under an extra cap provided in the area of said primary air inlet nozzle, and a liquid feeder tube connected thereto for supplying liquid from an external liquid source.

* * * * *